United States Patent [19]

Pollack

[11] Patent Number: 4,669,209

[45] Date of Patent: Jun. 2, 1987

[54] PICTURE FRAME

[76] Inventor: Ronald M. Pollack, 73-19 37th Rd., Jackson Heights, N.Y. 11372

[21] Appl. No.: 747,670

[22] Filed: Jun. 21, 1985

Related U.S. Application Data

[63] Continuation-in-part of Ser. No. 712,124, Mar. 15, 1985.

[51] Int. Cl.[4] ..... G09F 1/12

[52] U.S. Cl. ..... 40/152.1; 40/10 R; 40/156

[58] Field of Search ..... 40/10 R, 16 R, 152, 40/152.1, 156

[56] References Cited

U.S. PATENT DOCUMENTS

| | | | |
|---|---|---|---|
| 2,082,434 | 6/1937 | White | 40/209 |
| 4,145,828 | 3/1979 | Hillstrom | 40/156 |
| 4,237,632 | 12/1980 | Segerstad | 40/156 |
| 4,349,974 | 9/1982 | Rapeyellan | 40/156 |
| 4,516,342 | 5/1985 | Reim | 40/156 |

*Primary Examiner*—Gene Mancene

*Assistant Examiner*—Wenceslao J. Contreras

*Attorney, Agent, or Firm*—Collard, Roe & Galgano

[57] ABSTRACT

A picture frame for a poster and the like is provided which has an edge support for the edge of the poster, the edge support extends substantially the length of the respective poster edge and includes a back plate extending the length thereof and a substantially C-shaped member extending from the plane defined by the back plate. The C-shaped member is connected to the back plate and a leg of the C-shaped member extends towards the back plate to define a gap between the terminus of the leg and the back plate for the purpose of receiving the respective edge of the poster. At least one fastening element is associated with the edge support for fastening the respective poster edge thereto, the fastening element is substantially C-shaped to overlay the C-shaped member of said edge support and includes means to engage therewith. The leg of the fastening element overlaying the second leg of the C-shaped member extends into the gap between the leg and the back plate to press the poster edge against the back plate to thereby fasten the same thereto.

19 Claims, 12 Drawing Figures

PICTURE FRAME

This is a continuation-in-part application of my earlier filed application Ser. No. 712,124, filed Mar. 15, 1985, entitled "PICTURE FRAME".

The present invention relates generally to a picture frame for framing pictures and, more particularly, it relates to such a picture frame for the inexpensive framing of posters or prints and the like so as to present an aesthetically pleasing and yet very inexpensively framed picture.

In my earlier filed application identified above, I have described a picture frame which is very inexpensive and so easy to assemble that any one can do so with aesthetic and precise results. Basically, the picture frame of my earlier application comprises side members which engage with and hold the side edges of a picture and its protective coverings and elbow-shaped cornerpieces which engage the adjacent ends of adjacent side members to mask and conceal these ends an perpendicularly align the side members. The side members are formed of extruded plastic so that the ends may be cut to the length required for the picture to be framed and, because of the concealment thereof by the cornerpieces, little regard need be given to the accuracy or exactness of the end cut of the side members. Each cornerpiece is adapted to engage with and clamp onto the adjacent ends of adjacent side members by the exertion of a downward force on the cornerpiece in a direction perpendicular to the plane of the picture so that inadvertent distortion or misalignment of the picture frame and/or the parts being framed does not occur. This picture frame, although it is inexpensive and easy to assemble, is primarily adapted for the framing of pictures which include front and back protective coverings and supports such as the picture glass and a semi-stiff or rigid backing, respectively. Such protective coverings for the picture, being relatively stiff and unyielding, serve the purpose of maintaining the picture in a flat or planar attitude. The frame in such a case merely supports the various elements constituting the picture, i.e. the picture and its protective coverings, and holds the same together.

However, there is a certain class of pictures for which the use of a picture glass or other transparent covering and a semi-rigid backing is too extravagant in relation to the picture itself. Such pictures are in the form of posters, which tend to be relatively large, and prints. Artistic decor utilizing posters and large prints has come into vogue in recent years. Where such poster-type pictures are inexpensive, it is often times not worthwhile to provide the same with a glass covering and a semi-rigid backing together with a frame for the entire assembly, since these various extra elements often cost far in excess of the cost of the original poster to be framed. Thus, on many occasions, one sees attractive poster-like pictures which are tacked or otherwise fastened to a wall for the purpose of exhibiting the picture and maintaining it flat. Such securement of a poster-like picture to a wall not only causes damage to the wall but very often tends to be unsightly in that tacks or tape or some other objects are utilized in fastening the picture to the wall.

It is, therefore, a primary object of the present invention to provide a picture frame for a poster-like picture wherein no support elements or structure are utilized with the picture other than the picture frame itself, which is of simple and inexpensive construction.

This object, as well as others which will hereinafter become apparent, is accomplished in accordance with the present invention by the provision of a picture frame for poster-like pictures which includes at least a top picture edge support, a bottom picture edge support, and fastening elements which fasten the respective edges of the poster-like picture to the top and bottom supports. Each picture edge support includes a flat back plate which extends substantially the length of the edge of the picture being framed and a substantially C-shaped portion or member one leg of which is connected to the outer edge of the back plate while the other leg extends downwardly toward the flat back plate to define a gap between the terminus thereof and the back plate. The picture edge support is preferably formed of extruded plastic. The fastening elements are also generally C-shaped and resiliently engage around the generally C-shaped member of the edge support with the inside leg extending into the gap between the terminus of the inside leg of the C-shaped member and the flat back plate so as to press the edge of the poster-like picture inserted into the gap against the back plate of the edge support. The invention also contemplates the provision of edge supports for each side edge of the poster-like picture wherein the fastening elements are in the form of elbow-shaped cornerpieces which engage the adjacent ends of adjacent edge supports so as to secure or fasten the poster-like picture to the flat back plates of the supports at the corners of the picture.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
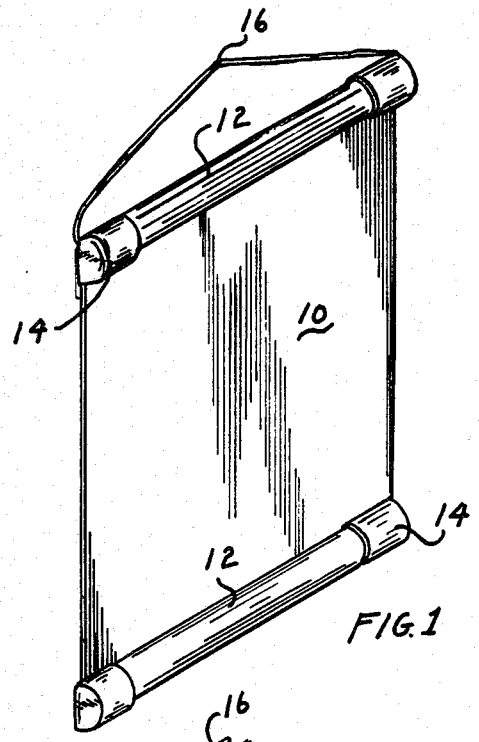
FIG. 1 is a perspective view of an assembled picture frame according to the present invention framing a poster-like picture.

Now turning to the drawings, there is shown in FIG. 1 a poster-like picture, designated 10, which is generally formed of relatively thin paper material. For the purpose of maintaining picture 10 flat so that it may be hung from a wall or similar structure without distortion, the upper edge and the lower edge of picture 10 are provided with substantially identical edge supports, designated 12, to which fastening elements 14 are engaged for securing picture 10 to the edge supports. A picture frame hanging wire 16 may also be provided in connection with the upper edge support for the purpose of hanging the picture.

Figure 2:
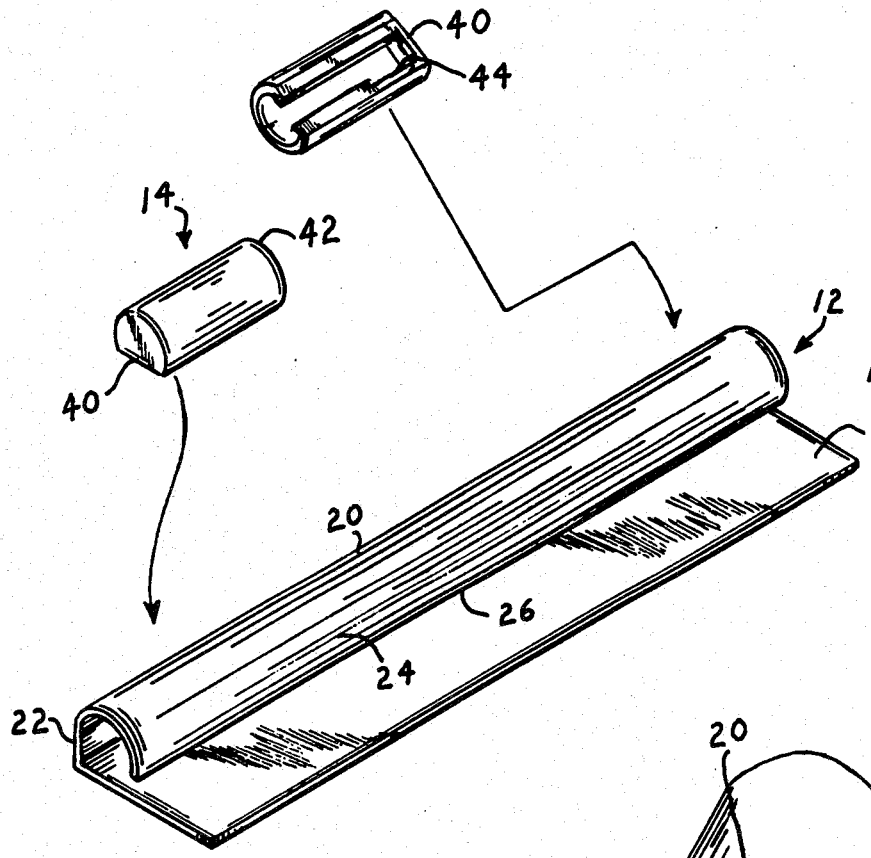
FIG. 2 is an enlarged perspective view in detail of an edge support and fastening elements of the picture frame of FIG. 1.

As clearly seen in FIG. 2, edge support 12 includes a flat back plate 18 which extends for the length of the edge support and which has extending upwardly from the plane defined by back plate 18 a substantially C-shaped member 20 having legs 22 and 24. As clearly seen, outer leg 22 is connected to the outer edge terminus of back plate 18 and inner leg 24 extends towards back plate 18 to define a gap 26 between the terminus of leg 24 and back plate 18. Gap 26 is sufficient to permit the insertion therein of the edge of the poster-like picture 10, as clearly seen in phantom in FIG. 3. Fastening element 14 is shown as having a substantially C-shaped configuration which basically conforms to the shape of member 20 of edge support 12 but having an inside diameter slightly smaller than the outside diameter of member 20 so that a snap fit results when fastening element 14 is engaged with member 20 because of the increased tension therebetween. The depending legs 28 and 30 of fastening element 14 are provided at their ends with engagement cams 32 and 34, respectively. As clearly seen in FIG. 3, leg 28 of fastening element 14 is slightly longer than leg 30 so that engagement cam 32 engages the corner defined by back plate 18 at its connection to outer leg 22 of C-shaped member 20 while engagement cam 34 engages the terminus 36 of leg 24 of C-shaped member 20. The foot of engagement cam 34, designated 38, extends into gap 26 below terminus 36 of leg 24 to press or pinion the edge of picture 10 against back plate 18 of support 12, thus fastening or securing picture 10 to edge support 12. As clearly seen in FIG. 2, fastening element 14 may be provided at one end thereof with a wall 40 so as to present a closed end therefor. Both ends of fastening element 14 are bevelled at 42 so that when the fastening elements are applied at the ends of edge supports 12, a very neat and aesthetic appearance is presented, as clearly seen in FIG. 1. Preferably, edge support 12 is formed of extruded plastic while fastening element 14 is formed of injection molded plastic.

In order to provide for picture frame hanging wire 16, a cut-out 44 is provided at the extreme outer end of engagement cam 32 of fastening element 14. Picture frame wire 16 is in the form of a continuous loop which passes through the cavity of C-shaped member 20 and out the ends thereof. The respective fastening elements 14 at the ends of support 12 are displaced sufficiently along member 20 to permit wire 16 to exit therefrom and hang relatively straight because of cut-out 44.

Figure 4:
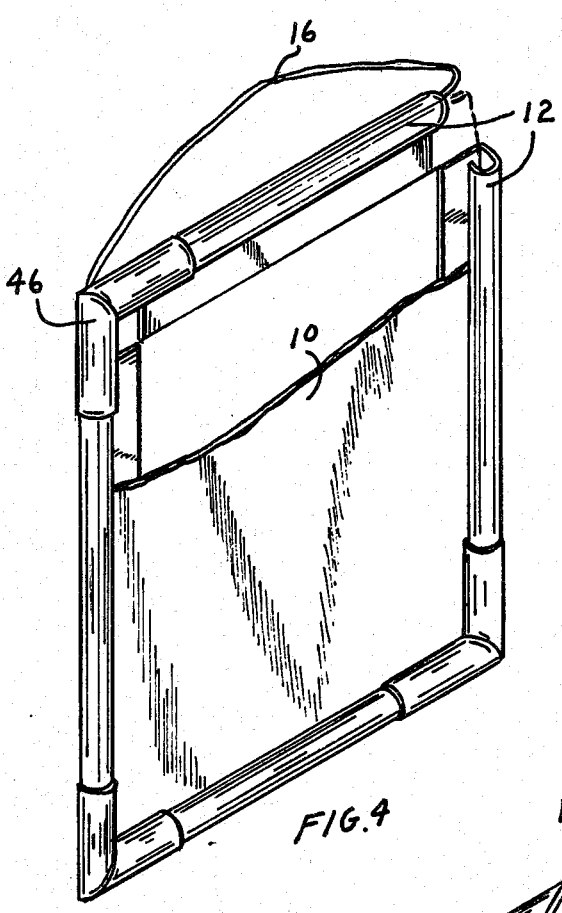
FIG. 4 is a perspective view of an assembled picture frame having four edge supports with a portion of the framed picture broken away.
Figure 5:
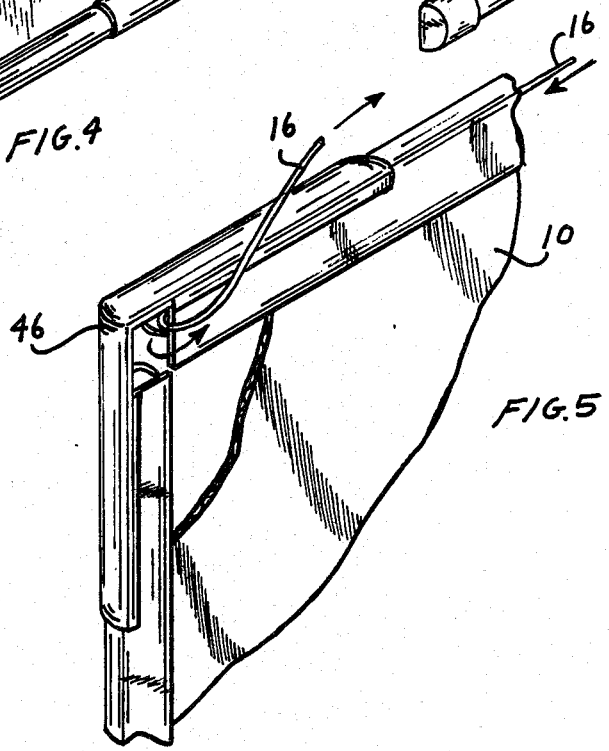
FIG. 5 is an enlarged perspective view of a portion of the picture frame of FIG. 4 as viewed from the rear thereof.

As clearly seen in FIG. 4, it is also possible to construct a frame for picture 10 which extends entirely around the picture. Thus, four edge supports 12 are provided, one for each edge of picture 10, with the adjacent ends of adjacent edge supports 12 being interconnected by means of elbow-shaped corner fastening elements 46. Each corner fastening element 46 is constructed and operates in the same manner as fastening elements 14 described above. Thus, in erecting the frame for picture 10, as shown in FIG. 4, each pair of adjacent edge supports 12 is positioned at the respective edges of picture 10 and the corner fastening element 46 is aligned with the ends of the adjacent edge supports and pushed downwardly to engage therewith and fasten the edges of picture 10 to the respective back plates 18. As seen in FIG. 5, the lengths of edge supports 12 are adjusted so that a corner space results at the back side of the picture frame which permits wire 16 to pass therethrough.

Figure 6:
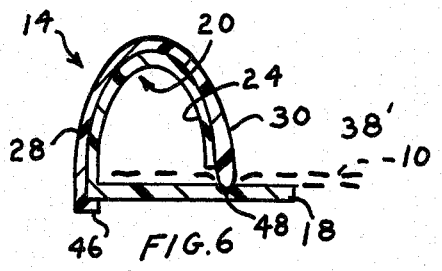
FIGS. 6 to 9 show additional constructions for the picture frame of the present invention.
Figure 7:
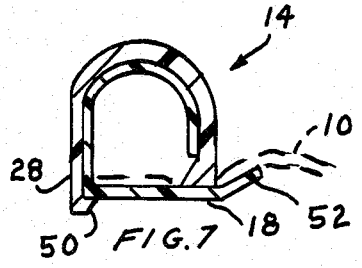
Figure 3:
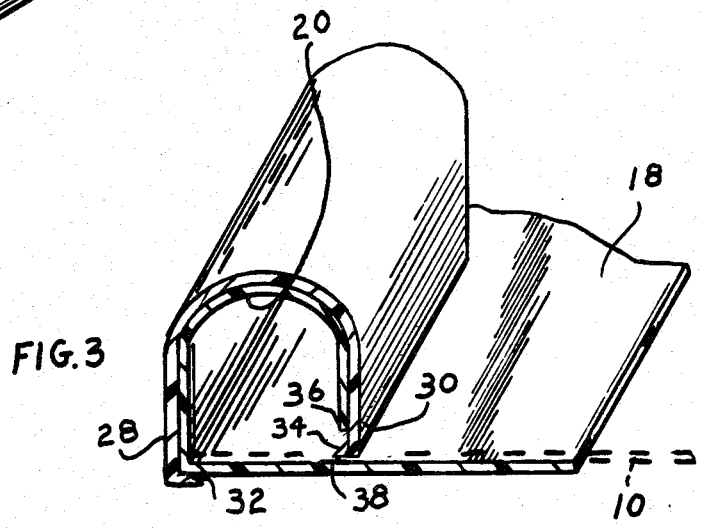
FIG. 3 is an enlarged cross-sectional view in perspective of an edge support and fastening element secured thereon.

In FIGS. 6 to 9, modifications of the picture fastening devices are shown. Thus, in FIG. 6, the outer leg 28 of fastening element 14 is provided with a hook 46 at the end thereof which engages the corner between back plate 18 and leg 22 of member 20. Leg 30 of fastening element 14 resiliently engages with leg 24 of the C-shaped portion 20 to be held thereon and the foot 38' extends into and engages with recess 48 formed in back plate 18 so as to press the edge of picture 10 therebetween. In FIG. 7, a construction similar to that shown in FIGS. 2 and 3 is shown except that a hook 50 is provided at the end of leg 28 for engagement with the bottom of back plate 18 rather than the engagement cam 32 of FIG. 3. Also, bottom plate 18 is provided with an upwardly extending ramp 52 at its free edge which allows the poster-type picture 10 to drape thereover away from the wall when it is hung.

Figure 8:
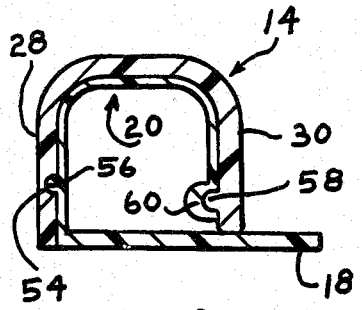
Figure 9:
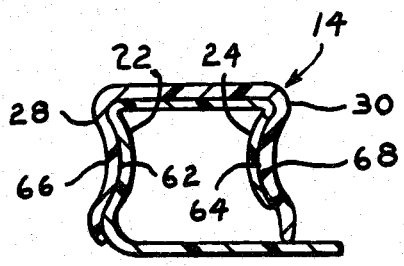

In FIG. 8, it is seen that fastening element 14 and member 20 of edge support 12 are engaged with each other by means of engagement ribs and complementary sockets. Thus, leg 28 of fastening element 14 is provided with a longitudinal socket 54 into which rib 56 of leg 22 extends. Leg 30 of fastening element 14 is provided with rib 58 which extends into socket 60 of leg 24 of member 20. In FIG. 9, legs 22 and 24 of member 20 are inwardly curved to form depressions 62 and 64, respectively. Legs 28 and 30 of fastening element 14 are curved at 66 and 68, respectively, to complement depressions 62 and 64 so that fastening element 14 engages with portion 20 of edge support 12 in a snap fit. The foot 70 of leg 30 extends up to back plate 18 so as to press against a picture therebetween.

Figure 11:
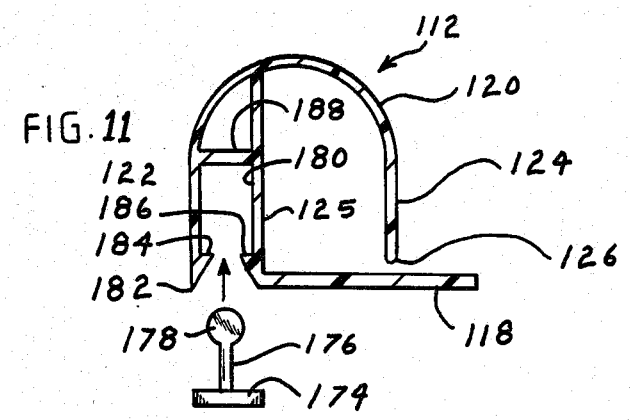
FIG. 11 is an exploded view of the embodiment shown in FIG. 10.
Figure 10:
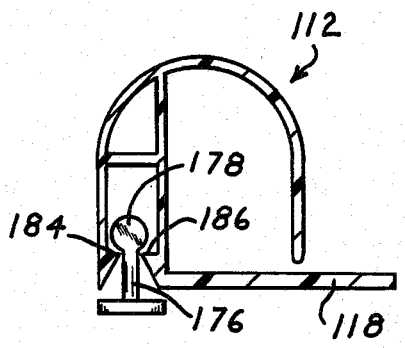
FIG. 10 is a cross-sectional view of another embodiment of an edge support of the picture frame together with a wall fasteninig device.
Figure 12:
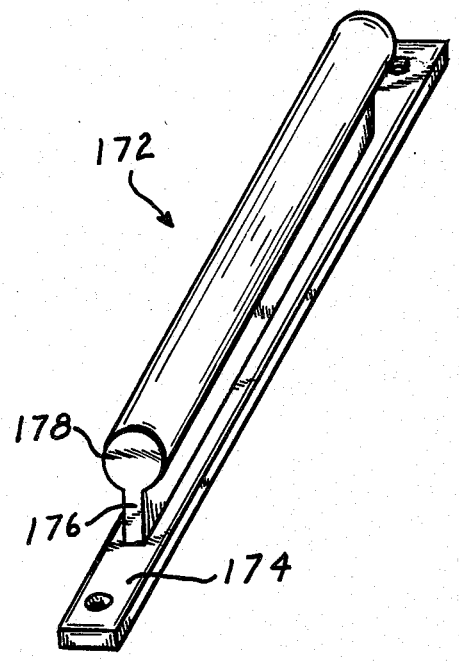
FIG. 12 is a perspective view of the wall fastening device of FIG. 10.

Another embodiment of the picture frame according to the present invention is shown in FIGS. 10 to 12. In accordance with this embodiment, the need for a picture frame hanging wire is eliminated. As seen in FIGS. 10 and 11, an edge support 112 similar to edge support 12 of FIGS. 1 to 9 is provided having a back plate 118 together with a substantially C-shaped member 120 extending upwardly from the plane thereof. C-shaped member 120 has depending outer leg 122 and depending inner leg 124 as well as a connecting flange 125 which is substantially parallel to legs 122 and 124 and which connects edge support 112 to the outer edge terminus of back plate 118. Depending inner leg 124 defines a gap, designated 126, between the terminus thereof and back plate 118 into which the edge of a poster-like picture is insertable and which can then be fastened and secured by means of fastening elements as above described in connection with FIGS. 1 to 9.

A wall fastening device, designated 172, fastens edge support 112 to the wall. Wall fastening device 172 is substantially an inverted T shape wherein bottom flange 174 is fastened to the wall by means of screws or other suitable means such as adhesive. The vertical flange 176 of device 172 is provided with an expanded end 178 which is received within elongated socket 180 of edge support 112. The aperture 182 of socket 180 is formed with a narrowed resilient gap defined by facing inward projections 184 and 186 located at the terminus of outer leg 122 and the terminus of back plate 118, respectively. The end 178 of flange 176 is received through the resilient gap defined between projections 184 and 186 and is thus engaged by socket 180. The strength of outer depending wall 122 of edge support 112 may be enhanced by providing an interconnecting brace, designated 188, between connecting flange 125 and wall 122.

While several embodiments of the present invention have been shown and described, it will be obvious that many changes and modifications may be made thereunto without departing from the spirit and scope of the invention.

What is claimed is:

1. A frame for a non-rigid paster and the like, comprising:

an edge support for an edge of said poster, said edge support extending substanially the length of the poster edge and including a back plate extending the length thereof and a substanially C-shaped member interconnected therewith and extending from the plane defined by said back plate having a first leg and a second leg, said second leg extending toward said back plate to define a gap between the terminus of said second leg and said back plate for the purpose of receiving the respective edge of said poster; and at least one fastening element associated with said edge support for fastening said poster edge thereto, said at least one fastening element having first and second legs and being substanially C-shaped to overlay the C-shaped member of said edge support and engage therewith with a snap fit, the second leg of said fastening element extending beyond the terminus of the second leg of said C-shaped member and toward said back plate to press the poster edge against said back plate to thereby fasten the same.

2. The frame as defined in claim 1, wherein the engagement of said fastening element to said C-shaped member of said edge support includes inwardly directed engagement cams at the ends of said first and second legs of said C-shaped fastening element, the engagement cam of said first leg being adapted to engage by means of a snap fit the terminus of the first leg of said C-shaped member, and the engagement cam of said second leg of said fastening element being adapted to engage by means of a snap fit the terminus of said second leg of said C-shaped member.

3. The frame as defined in claim 1, wherein at least two edge supports are provided, one for the top edge of said poster and one for the bottom edge.

4. The frame as defined in claim 1, wherein the first leg of the C-shaped member of said edge support is connected to the outer edge terminus of said back plate.

5. The frame as defined in claim 1, wherein a flange is provided on said C-shaped member of said edge support substantially parallel to the first and second legs thereof and connected to the outer edge terminus of said back plate.

6. The frame as defined in claim 2, wherein a fastening element is provided at each end of said edge support.

7. The frame as defined in claim 6, wherein the outer end of each fastening element is provided with a wall closing the end thereof.

8. The frame as defined in claim 1, which further comprises an edge support for each side edge of said poster.

9. The frame as defined in claim 8, wherein the fastening elements comprise elbow-shaped cornerfastening elements which engage with the ends of adjacent edge supports and fasten the corners of said poster to adjacent edge supports.

10. The frame as defined in claim 9, wherein an elbow-shaped corner fastening element is provided at each corner of said poster to engage with adjacent ends of adjacent edge supports.

11. The frame as defined in claim 7, wherein a cut-out is provided in the engagement cam of the leg of said fastening element which engages the corner between said back plate and said first leg of the C-shaped member of said edge support, said cut-out being adjacent to said end wall, and said frame further including a picture hanging wire in the form of a continuous loop passing through the cavity defined by the C-shaped edge support and exiting at the ends thereof at the cut-outs in said fastening element.

12. The frame as defined in claim 1, wherein the engagement of said fastening element to the edge support includes a longitudinal socket and a longitudinal rib fitted therein associated with each of said first and second legs of said fastening element and said C-shaped member of said edge support.

13. The frame as defined in claim 1, wherein the first and second legs of said C-shaped member of said edge support include a longitudinally extending concave depression and said first and second legs of said fastening element include complementary curvatures which engage therewith to provide a resilient engagement between said fastening element and said edge support.

14. The frame as defined in claim 1, wherein said edge supports are formed of plastic extrusions and said fastening elements are formed of injection molded plastic.

15. The frame as defined in claim 1, which further includes a wall fastening device having an elongated member securable to a wall and an elongated leg extending therefrom releasably engageable with said edge support supporting the edge of said poster.

16. The frame as defined in claim 15, wherein an elongated socket is provided in said edge support for receiving said elongated leg of said wall fastening device.

17. The frame as defined in claim 16, wherein the aperture of said elongated socket is formed with a narrowed resilient gap defined between the terminus of the first leg of the C-shaped member of said edge support and the outer edge terminus of said back plate.

18. The frame as defined in claim 17, wherein the end of the leg of said wall fastening device is expanded so that upon insertion into the elongated socket of said edge support it is gripped by the narrowed resilient gap of the aperture thereof.

19. The frame as defined in claim 1, wherein the inside diameter of said C-shaped fastening element is slightly smaller than the outside diameter of the C-shaped member of said edge support.

* * * * *